US007069960B2

(12) United States Patent
Nakada et al.

(10) Patent No.: US 7,069,960 B2
(45) Date of Patent: Jul. 4, 2006

(54) METHOD OF CONTROLLING PILE FABRIC LOOM

(75) Inventors: Akihiko Nakada, Kanazawa (JP); Akihiko Yamamoto, Kanazawa (JP); Masato Matsumoto, Kanazawa (JP); Tomokazu Ishita, Kanazawa (JP)

(73) Assignee: Tsudakoma Kogyo Kabushiki Kaisha, Ishikawa-Ken (JP)

( * ) Notice: Subject to any disclaimer, the term of this patent is extended or adjusted under 35 U.S.C. 154(b) by 241 days.

(21) Appl. No.: 10/718,323

(22) Filed: Nov. 21, 2003

(65) Prior Publication Data

US 2004/0099325 A1 May 27, 2004

(30) Foreign Application Priority Data

Nov. 21, 2002 (JP) ..... 2002-337498

(51) Int. Cl.
*D03D 49/06* (2006.01)

(52) U.S. Cl. ..... 139/105; 139/25; 139/37; 139/100; 139/102; 139/103

(58) Field of Classification Search ..... 139/25, 139/37, 100, 102, 103, 105
See application file for complete search history.

(56) References Cited

U.S. PATENT DOCUMENTS 3,240,235 A * 3/1966 Burgess ..... 139/25
3,910,317 A * 10/1975 Seifert ..... 139/102
4,259,994 A * 4/1981 Hobson ..... 139/1 R
4,827,985 A * 5/1989 Sugita et al. ..... 139/25
5,002,095 A 3/1991 Herrin et al.
5,014,756 A * 5/1991 Vogel et al. ..... 139/97
5,568,826 A * 10/1996 Vogel et al. ..... 139/25
5,722,464 A * 3/1998 Truyen et al. ..... 139/25
6,029,715 A 2/2000 Matsumoto et al.

FOREIGN PATENT DOCUMENTS

| | | |
|---|---|---|
| EP | 0 257 857 | 3/1988 |
| JP | 63-264946 | 11/1988 |
| JP | 3-27150 | 2/1991 |
| JP | 4-289242 | 10/1992 |
| JP | 9-105050 | 4/1997 |

* cited by examiner

*Primary Examiner*—John J. Calvert
*Assistant Examiner*—Robert Muromoto
(74) *Attorney, Agent, or Firm*—Wenderoth, Lind & Ponack, L.L.P.

(57) ABSTRACT

A control technique is capable of adjusting a weight of a pile fabric by adjusting consumption of a pile warp at a proper range with a more simplified system. In a pile loom, a tolerance relative to a value associated with consumption of the pile warp is set, and the value associated with consumption of the pile warp is measured during a pile weaving period. If the value associated with consumption of the pile warp exceeds the tolerance, the weaving condition parameter associated with the weight of the pile is corrected in a direction to approach a target value of the weight of a pile fabric.

22 Claims, 13 Drawing Sheets

METHOD OF CONTROLLING PILE FABRIC LOOM

FIELD OF THE INVENTION

The invention relates to a method of controlling a pile loom comprising the steps of measuring a value associated with the amount of consumption (hereinafter simply referred to as consumption) of a pile warp consumed in a pile loom, and correcting a parameter of a weaving condition (hereinafter referred to as weaving condition parameter) associated with a weight of the pile in a direction to approach a target value of the weight of the pile fabric when the value associated with consumption of the pile warp deviates from a tolerance.

BACKGROUND OF THE INVENTION

JP-A 1991-27150 and JP-A 1992-289242 disclose the ratio of consumption between a ground warp and a pile warp, namely, disclose that a pile scale factor is compared with a target value, and a swinging torque of a tension roll of the pile warp is adjusted in a direction to cancel the amount of deviation relative to the target value, thereby changing the pile warp tension or adjusting a reed escape amount (appropriate distance between the position of the cloth fell caused by the movement of a cloth and the original position of the cloth fell, i.e. beating position of the cloth fell).

Further, JP-A 1988-264946 discloses a pile loom for rotatably driving a ground warp beam at a speed corresponding to a weaving speed (taking-up speed) wherein the number of revolutions of the pile warp beam is controlled such that the rotation of the pile warp beam is controlled in a direction to keep the deviation of the warp tension, and the ratio of consumption between the ground warp and the pile warp, namely, the pile scale factor.

Any of the foregoing techniques functions to keep the pile scale factor, in other words, the consumption of the pile warp, at a target value. However, in any of the techniques, the weaving condition such as pile warp tension is frequently adjusted in a direction to allow the pile scale factor to approach the target value, which causes problems in that the operation of the loom is unstable and the quality of the pile fabric is deteriorated.

SUMMARY OF THE INVENTION

Accordingly, the object of the invention is to provide a control technique of a pile loom capable of adjusting consumption of the pile warp at an appropriate range with a more simplified system, thereby adjusting the weight of a pile fabric without deteriorating the operation of the loom and deteriorating the quality of the pile fabric.

To achieve the above object, in the pile loom of the invention, a tolerance relative to a value associated with consumption of the pile warp is set, and the value associated with the consumption of the pile is measured. If the value associated with consumption of the pile warp deviates from the tolerance, a weaving condition parameter associated with the weight of the pile fabric is corrected in a direction to approach the target value of the weight of a pile fabric.

The values associated with consumption of the pile warp include a pile scale factor, namely, the ratio between consumption of the ground warp and consumption of the pile warp, and consumption of the pile warp per unit time.

Further, a tolerance to be set is preferably determined considering the standard of the pile fabric (tolerance of weight per unit area).

There are the following items (1) to (4), relating to weaving condition parameters and concrete correction, namely, item (1) relating to a pile warp tension, item (2) relating to a ground warp tension, item (3) relating to a weft density, item (4) relating to a terry motion, and so forth, which are used singly or in a combination of not less than two thereof.

For the item (1) relating to pile warp tension, there are an urging force of a pile warp tension roll, the number of revolutions of a pile warp beam, and so forth. If the pile warp tension increases, the pile is difficult to be formed, so that the height of the pile decreases, and hence the weight of the pile fabric decreases. On the other hand, if the number of revolutions of the pile warp beam (feed speed) decreases, the pile warp tension increases, and the height of the pile decreases, and hence the weight of the pile fabric decreases. The pile warp tension may be corrected during the entire period where pile weaving is executed, or the pile warp tension alone may be corrected during a part of the period, e.g., a period where a relative movement between a reed 28 and pile fabric 7 is performed (a period where the cloth fell 7*a* of the woven cloth 7 is moved back and forth, hereinafter referred to as the same). For example, in the case where a tension roll 6 for pile warp 2 is subjected to positional control driving during a period which is set corresponding to the period where the relative movement between the reed 28 and the pile fabric 7 is performed for generating pile, a period for executing the positional control may be considered to relate to the pile warp tension.

For the item (2) relating to ground warp tension, there are set tension of the ground warp and easing amount of the ground warp. If the ground warp tension increases during weaving of a heavyish pile fabric, the weft is easily beaten up so that the returning amount of the cloth fell caused by the overabundance of the cloth fell decreases, so that the height of the pile increases, in other words, consumption of the pile warp increases and the weight of the pile fabric increases. The weft is easily beaten up by appropriately decreasing the easing amount of the ground warp for correcting warp distortion owing to the shedding path, thereby increasing the weight of the pile fabric.

For the item (3) relating to a weft density (beating density of a weft), there is the number of revolutions of a take-up roll. During the weaving of the heavyish pile fabric, if the number of revolutions of the take-up roll increases, namely, the number of beating decreases, the weft is easily beaten up, so that the returning amount of the cloth fell caused by the overabundance of the cloth fell at the beating time decreases and the height of the pile increases, in other words, consumption of the pile warp increases, thereby increasing the weight of the pile fabric. On the other hand, if the number of revolutions of the take-up roll decreases during weaving of the pile fabric which is lightish and hardly has overabundance, namely, if the weft density increases, the weight of the weft of the pile fabric increases, thereby increasing the weight of the pile fabric.

For the item (4) relating to a terry motion, for example, if the reed escape amount increases using an electronic pile device, the height of the pile increases to increase consumption of the pile warp, thereby increasing the weight of the pile fabric.

Although there are considered the change in height of the pile (consumption of the pile warp) and the problem of the weft (variation caused by lot) as causes of the change of the weight of the pile fabric, each cause appears finally as a change in consumption of the pile warp, and thus a change in pile scale factor in the operation of the pile loom. If the tolerance is set conforming to the range of the standard of the pile fabric relating to the weight, the adjustment of the weaving condition parameter is restrained to the minimum, so that deterioration of the quality of the pile fabric caused by the frequent adjustment as made conventionally does not occur, and also the operation of the pile loom can be stabilized. The amount of correction of the weaving condition parameter can be structured to be determined in response to the magnitude relation relative to the threshold of the tolerance or in response to the amount of deviation of the pile scale factor relative to the threshold of the tolerance.

PREFERRED EMBODIMENTS OF THE INVENTION

Figure 1:
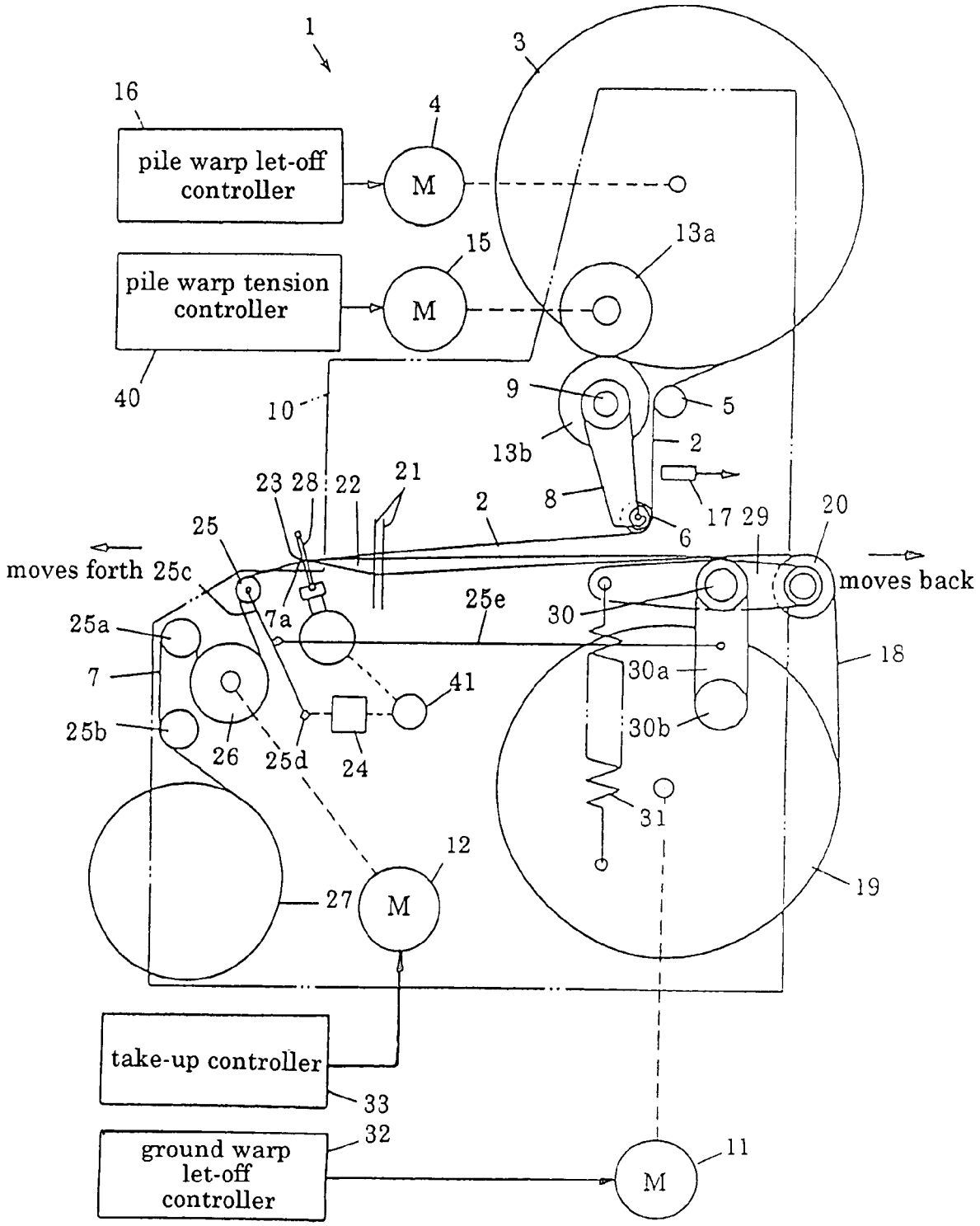
FIG. 1 is a side view of a main portion of a pile loom.

FIG. 1 shows an entire cloth movable type pile loom 1 as an example. The pile loom 1 moves a beating position of a reed 28 and a cloth feel 7*a* of a woven cloth 7 serving as a pile fabric relative to each other by moving a cloth fell 7*a* of the woven cloth 7 back and forth periodically for pile formation by a pile warp 2.

Many pile warps 2 are wound around an outer periphery of a let-off beam 3 in a sheet shape along a weaving width, and they are positively let off by the rotation of a let-off motor 4, then they are extended around outer peripheries of a guide roll 5 and a tension roll 6, and thereafter supplied in a direction of the cloth fell 7*a*. The guide roll 5 is supported at a fixed position relative to a loom frame 10.

The tension roll 6 is rotatably supported back and forth by a tension lever 8 and a fulcrum shaft 9 serving as a mechanical supporting system relative to the loom frame 10. The tension lever 8 is rotatably supported by the fulcrum shaft 9 at a fixed position of the loom frame 10 and it is urged by a spring, not shown, in a direction to always apply a fixed tension relative to the pile warp 2, if need be.

The fulcrum shaft 9 is to be driven by an electric actuator 15 such as an AC servomotor or a torque motor via gears 13*a*, 13*b*. The electric actuator 15 is to be controlled by a pile warp tension controller 40, and is turned in either direction to generate a turning force (torque) proportional to a current value.

In such a manner, the pile warp tension controller 40 converts an electric signal serving as an output of the pile warp tension controller 40 into a turning force which is proportional to the magnitude of the electric signal by controlling the electric actuator 16, and further converts the turning force into displacement (movement) of the gears 13*a*, 13*b*, the fulcrum shaft 9, the tension lever 8 and the tension roll 6, thereby causing the displacement to act upon the pile warp 2. As a result a tension of the pile warp 2 can be adjusted to increase or decrease by the output of the pile warp tension controller 40 during a weaving process.

Meanwhile, the let-off motor 4 is controlled by a pile warp let-off controller 16. The pile warp let-off controller 16 indirectly measures consumption of the pile warp 2 as weaving operation advances by sampling the displacement of the tension roll 6 or tension lever 8 which is detected by a displacement detector 17 at a prescribed cycle, and drives the let-off motor 4 in a let-off direction corresponding to the thus measured consumption and lets off the pile warp 2.

The pile warp let-off controller 16 adds the number of revolutions corresponding to the displacement of the tension roll 6 to a basic number of revolutions (revolution speed) of the let-off motor 4 or subtracts the number of revolutions corresponding to the displacement of the tension roll 6 from the basic revolution speed of the let-off motor 4, and drives the let-off motor 4 at the total number of revolutions after execution of addition or subtraction thereof in a direction to always let off the pile warp 2 during weaving. Since the pile warp let-off controller 16 is a feed back control system and normally responds to a large time constant, it does not control a temporal displacement of the tension roll 6 in the back and forth direction at the time of a shedding operation of the pile warp 2 and a ground warp 18 or at the time of pile formation.

Meanwhile, the ground warp 18 is supplied by a ground warp let-off beam 19 in the same manner as conventionally, and it is wound around a back roll 20 and guided forward to be inserted into heddles 21, thereby forming a shedding 22 together with the pile warp 2 by the vertical movement of the heddles 21. The ground warp 18 crosses a weft 23 at the position of the shedding 22 and forms the woven cloth 7 of a pile tissue together with the weft 23 which is beaten by the reed 28. The woven cloth 7 is wound around an outer periphery of a take-up beam 27 after passing through a guide roll 25 which is displaceable back and forth, a take-up roll 26 at a fixed position, and a plurality of guide rolls 25*a*, 25*b*.

Owing to the weaving by the movable type pile loom, the back roll 20 is also displaceably supported in the back and forth direction by a ground warp tension lever 29 which is freely rotatable relative to a fulcrum shaft 30 in the same manner as the guide roll 25, and it is urged by a tension spring 31 in a direction to apply a prescribed tension to the ground warp 18. Further, the fulcrum shaft 30 is supported by a supporting arm 30*a* in a state to be able to swing back and forth relative to the loom frame 10 about a fulcrum shaft 30*b*.

The guide roll 26 is supported by a lever 25*c* and a lever shaft 25*d* in a state to be able to swing back and forth, and is coupled to the supporting arm 30*a* by a link 25*e*, and it is moved back and forth by a terry motion mechanism 24 which is driven by a main shaft 41 of the pile loom 1. In such a manner, both the back roll 20 and the guide roll 25 swing back and forth corresponding to the pile formation cycle, and allows the woven cloth 7 and cloth fell 7*a* to move back and forth.

Although a beating position is always fixed in the cloth movable type pile loom 1, both the woven cloth 7 and the cloth fell 7*a* are moved back and forth. Both the guide roll 25 relative to the woven cloth 7 and the back roll 20 relative to the ground warp 18 are supported in a state to be displaceable back and forth as set forth above, and when the guide roll 25 and the back roll 20 are moved back and forth upon completion of beating of the first pick in a state where they are normally synchronous with the rotation of the main shaft 41 by the terry motion mechanism 24, the cloth fell 7*a* is allowed to move forward (cloth taking-up side) and an appropriate reed escape amount is given by two times loose pickings.

In the meantime, in the pile weaving, "first pick" means the complete beating of the weft 23 until the weft 23 reaches the cloth fell 7*a* while "loose picking" means beating of the weft 23 until the weft 23 reaches merely up to a position corresponding to the reed escape amount in front of the cloth fell 7*a* but does not mean the complete beating of the weft 23 until the weft 23 reaches the cloth fell 7*a*.

The pile warp 2 is let off by controlling the let-off amount to increase or decrease in response to the movement of the tension roll 6 while it is let off at a basic speed as set forth above without direct connection with the back and forth movement of the back roll 20 and the guide roll 25. On the other hand, the ground warp let-off beam 19 and the take-up roll 26 are driven by driving motors 11 and 12. Further, the driving motor 11 is driven by a ground warp let-off controller 32 under the tension control. The driving motor 12 is driven by a take-up controller 33 in a state to be synchronous with the rotation of the main shaft 41. Meanwhile, the take-up beam 27 is rotatably driven by the electric motor or a mechanical let-off mechanism in the same manner as the conventional technique.

When the pile loom 1 operates to advance the weaving operation, the pile warp 2 is woven in the woven cloth 7, and hence the warp 2 is sequentially moved forward so that the tension of the pile warp 2 gradually increases. Since the tension roll 6 is moved forward associated therewith, the tension lever 8 is turned clockwise in FIG. 1. The displacement of the tension roll 6 or the tension lever 8 at this time is always detected by the displacement detector 17 as an electric signal which is proportional to the amount of displacement. Although the detection of the displacement is always continuously performed, the detected electric signal is utilized for the let-off control every prescribed sampling cycle by a sampling technique, described later.

Since the signal detected by the displacement detector 17 becomes an input of the pile warp let-off controller 16, the pile warp let-off controller 16 samples the detected signal at a prescribed timing and determines an average value per prescribed pick unit and calculates a command speed based on the amount of deviation relative to a reference value so that the average position of the tension roll 6 for the pile warp 2 reaches a prescribed position, whereby the let-off motor 4 positively turns to turn the let-off beam 3 of the pile warp 2 in the let-off direction. When the let-off beam 3 of the pile warp 2 lets off the pile warp 2, the increase of the tension of the pile warp 2 is restrained and a sharp tension variation of the pile warp 2 caused by the displacement of the tension roll 6 or the tension lever 8 is cancelled.

The let-off operation of the ground warp 18 is performed by the let-off driving motor 11 and the ground warp let-off controller 32. The ground warp let-off controller 32 always continuously lets off the ground warp 18 at a command speed corresponding to a basic speed, detects the tension of the ground warp 18 during a let-off process, compares the detected tension with a target tension, corrects the basic speed so that the tension of the ground warp 18 is equal to the target tension value, and finally outputs the result of correction as the command speed. Thus, the let-off operation of the ground warp 18 is always continuously performed, and the let-off operation speed is varied in response to the deviation relative to the target tension value.

Figure 2:
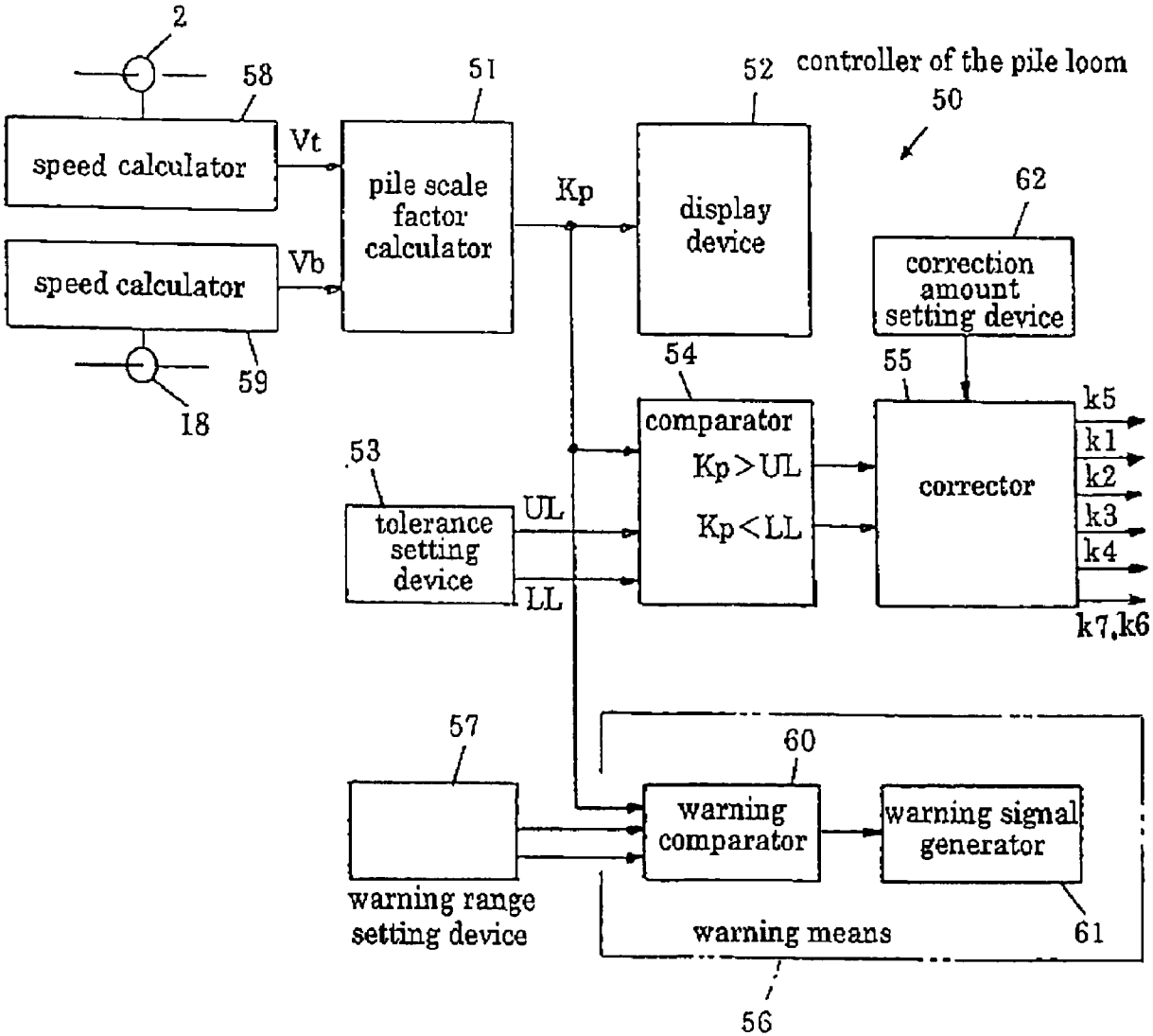
FIG. 2 is a block diagram of a controller of the pile loom.

Next, FIG. 2 shows a controller 50 of the pile loom 1. In FIG. 2, the controller 50 of the pile loom 1 comprises a pile scale factor calculator 51, a display device 52, a tolerance setting device 53, a comparator 54, a corrector 55, warning means 56, a warning range setting device 57 and so forth. The pile scale factor calculator 51 is connected to a speed calculator 58 of the pile warp 2 and a speed calculator 59 of the ground warp 18 at its input terminals, respectively, and to the display device 52 at its output terminal. The output terminal of the pile scale factor calculator 51 is branched and connected to an input terminal of the comparator 54 and an input terminal of a warning comparator 60 inside the warning means 56.

The comparator 54 is connected to the tolerance setting device 53 at its other input terminals, and to the corrector 55 at its output terminals. The corrector 55 is also connected to a correction amount setting device 62 at its input terminal for generating a prescribed correction amount signal based on the result of comparison. The warning comparator 60 is connected to the warning range setting device 57 at its input terminals and to a warning signal generator 61 at its output terminal.

Both the speed calculators 58, 59 detect consumption of the warp, respectively, and output a signal representing a speed of consumption corresponding to consumption of the warp, respectively. For example, both the speed calculators 58, 59 measure, e.g., an actual feed speed Vt of the pile warp 2 based on the rotation of the pile warp 2 or the let-off beam 3, or measure an actual feed speed Vb of the ground warp 18 based on the rotation of the ground warp 18 or the ground warp let-off beam 19, then supply the result of measurement to the pile scale factor calculator 51. The pile scale factor calculator 51 determines an actual pile scale factor Kp as the ratio of feeding amount based on a calculation formula of the pile scale factor Kp, i.e., $Kp=Vt/Vb$, and it supplies data representing the actual pile scale factor Kp to the display device 52.

The calculation formula of the above pile scale factor Kp is replaced with $Kp=Vt/Vb=Vt\cdot t/Vb\cdot t=Lt/Lb$ where t is time, Lt is feeding amount (consumption) of the pile warp 2, and Lb is feeding amount (consumption) of the ground warp 18. It is found from this calculation formula that the calculation of the ratio of feeding amount is to eliminate time t from the calculation formula, and hence it corresponds to determination of the ratio between the feeding amount Lt (consumption) of the pile warp 2, and the feeding amount Lb (consumption) of the ground warp 18.

Although the pile scale factor calculator 51 determines the pile scale factor Kp as its name indicates, the object to be determined may be the calculation of consumption of the pile warp 2 per unit time, or may be the calculation of consumption of the ground warp 18, if need be. From this, the pile scale factor calculator 51 can be structured as a consumption calculator of the pile warp 2 (or consumption calculator of the ground warp 18). Further, the applicant proposed a method of calculating the pile scale factor which is more precise in calculation accuracy by obviating data necessary for calculating speed of the warp such as a winding diameter of each beam and gear ratio between the beams in the step of calculating the pile scale factor based on each number of revolutions of the ground warp let-off beam 19 and the let-off beam 3 of the pile warp 2 during pile weaving or ground weaving, and also proposed a technique to allow the result of calculation set forth above to approach an actual value obtained by multiplying a prescribed coefficient by the result of calculation, wherein the calculated values determined by the above calculation can be applied to the present invention. Those techniques are disclosed in JP-A 1997-106050.

The display device 52 displays the pile scale factor Kp thus determined by the pile scale factor calculator 51 to an operator in a state to be visually confirmed rather than the numerical value thereof. Accordingly, the operator can easily confirm the pile scale factor Kp during weaving. The pile scale factor Kp or the calculation of consumption of the pile warp 2, and the display thereof, are performed every prescribed period of time. Accordingly, the controller 50 of the pile loom (pile scale factor calculator 51) calculates the pile scale factor Kp every prescribed period of time, and displays it or displays the calculated pile scale factor Kp only every prescribed period of time.

The prescribed period of time is either of a fixed period of time (time or number of picks during weaving) during weaving of a product, a fixed period of time (time or number of picks during weaving) during a pile tissue weaving in the weaving of a product, or entire period of time (time or number of weaving pick) during a pile tissue weaving per unit product.

Assuming that the prescribed period of time is every elapse of a fixed period of time during the pile tissue weaving, it is possible to confirm a state of fluctuation in height of the pile during the pile weaving process by monitoring the pile scale factor Kp every fixed period. Upon confirmation of the pile scale factor Kp, if the administrator decides that the pile scale factor Kp deviates from a prescribed reference, the administrator stops the pile loom 1 and operates the necessary spot or spots to be adjusted in a direction to set the pile scale factor Kp within the prescribed reference value. As a result, the pile scale factor Kp and the height of the pile can be set manually within a target reference value. Further, in these cases, signals outputted during the pile weaving period, e.g., a pile weaving command signal or in the case where a specific weft 23 is selected during the pile weaving period, the output of a signal representing the selection of the weft 23 has to be recognized by the pile scale factor calculator 51, and it is sufficient that the pile scale factor Kp is calculated and outputted for a period of time when these signals are outputted.

If a prescribed period is an entire period during the pile tissue weaving per unit product, the pile scale factor Kp thus determined becomes a value obtained by adding up all the pile tissues in the case where a plurality of pile tissues are dispersely present in one product, and it becomes a parameter showing the weight of the pile which is one of the standard for the product.

Provided that the prescribed period of time is a fixed period during weaving of the product, in the case where a border tissue other than the pile tissue is present in the product, the pile scale factor of the border tissue is also displayed. Although it is not necessary to particularly administrate the pile scale factor in the border tissue, since the most of the products of the pile fabric is formed of a pile tissue, even if the pile scale factor of the pile fabric including the border tissue at a part thereof is displayed during the entire period, it is practically permissible because this period is very short.

Further, the pile scale factor calculator 51 supplies the pile scale factor Kp which has be calculated as set forth above to the comparator 54. Then the comparator 54 compares the tolerance between an upper limit pile scale factor UL and a lower limit pile scale factor LL, which are set by the tolerance setting device 53, respectively, with the pile scale factor Kp which was determined by the pile scale factor calculator 51, and generates a comparison result signal corresponding to the result of comparison, i.e., Kp>UL, Kp<LL, and supplies it to the corrector 55.

The calculation or comparison of the pile scale factor Kp can be performed only during weaving of the pile tissue. That is, the pile scale factor Kp is calculated only within a pile tissue weaving period, which is in turn compared with the tolerance or the calculated pile scale factor Kp is compared with the tolerance only within the pile tissue weaving period. By doing so, the pile scale factor Kp during weaving of a border tissue is compared with the tolerance, thereby preventing an erroneous comparison result from being outputted. Meanwhile, within the pile tissue weaving period, the calculation or the comparison of the pile scale factor Kp can be performed every fixed period or every entire period of weaving the pile tissue every per unit product in the same manner as the display of the pile scale factor Kp.

If the actual pile scale factor Kp is within the tolerance, the comparator 54 does not generate an output for the correction. However, if the pile scale factor Kp deviates from the tolerance, the comparator 54 outputs a comparison result signal to actuate the corrector 55. The corrector 55 receives data of the correction amount relative to the comparison result signal which is set in advance in the correction amount setting device 62 and generates correction amount signals corresponding to the manner of correction, such as a signal representing a pile warp tension correction amount k1, a signal representing a ground warp tension correction amount k2, a signal representing a weft density correction amount k3, and a signal representing a let-off beam rotation correction amount k4, and a signal representing a terry amount correction amount k5, if need be.

The signals representing correction amount (the signal representing the pile warp tension correction amount k1, the signal representing the ground warp tension correction amount k2, the signal representing the weft density correction amount k3, and the signal representing let-off beam rotation correction amount k4, and the signal representing the terry amount correction amount k5, if need be) are signals including the symbol of plus, minus and the magnitude, wherein the symbol of the plus, minus determines the direction of the correction and the magnitude (absolute value) includes the correction amount. Data of the correction amount relative to the comparison result signal is set in advance in the correction amount setting device 62.

The signal representing the pile warp tension correction amount k1 becomes an input of correction for the pile warp tension controller 40, the signal representing the ground warp tension correction amount k2 becomes an input of correction for the ground warp let-off controller 32, and the signal representing the weft density correction amount k3 becomes an input of correction for the take-up controller 33 and the signal representing the let-off beam rotation correction amount k4 becomes an input of correction for the pile warp let-off controller 16. Further, the signal representing the terry amount correction amount k5 becomes an input for the terry motion mechanism 24.

In such a manner, the signals representing the correction amount are used for correcting at least one weaving condition parameter associated with the weight of the pile in a direction to return the pile scale factor Kp to a value within the tolerance or used for correcting at least one weaving condition parameter associated with the weight of the pile in a direction to return consumption of the pile warp 2 to a value within the tolerance.

Meanwhile, when the pile scale factor Kp deviates from the warning ranges, the warning comparator 60 generates an output for warning, and drives the warning signal generator 61 to generate a light or sound warning signal, which is noted to an administrator. As a result, the pile loom is rendered in a state where an anomaly can be easily known, so that a variation caused by human decision does not cause a problem, and a reliability of the control is improved, which saves time and labor.

Figure 3:
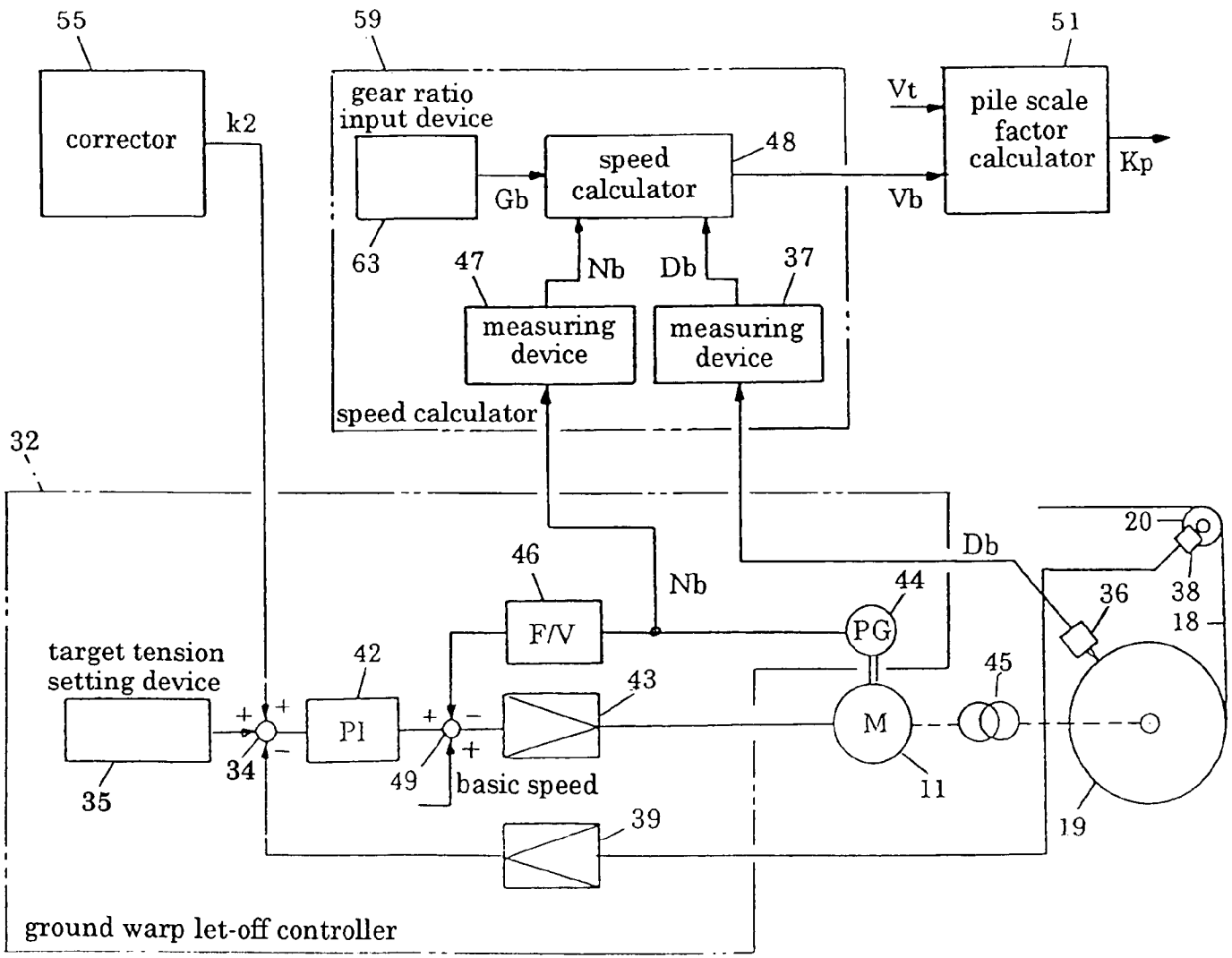
FIG. 3 is a block diagram of a ground warp let-off controller.

FIG. 3 shows an example of the ground warp let-off controller 32. The ground warp 18 is unwound from the ground warp let-off beam 19 and contacts the back roll 20, then it is let-off to the cloth fell 7*a*. A winding diameter Db of the ground warp let-off beam 19 is detected by a winding detector 36 and supplied to a measuring device 37. A tension of the ground warp 18 is detected by a pressure detector 38 at the position of the back roll 20 and supplied to an addition point 34 via an amplifier 39. A target tension at the let-off time is given to the addition point 34 by a target tension setting device 35.

Accordingly, a PI controller 42 controls the number of revolutions of the let-off driving motor 11 through the driving amplifier 43 based on the proportion and integration operation in response to the deviation between the tension of the ground warp 18 and the target tension, and turns the ground warp let-off beam 19 through the reduction gear 45 in the let-off direction. The number of revolutions of the let-off driving motor 11 at this period is detected by the pulse generator 44, and given to the measuring device 47 for measuring a motor speed Nb and the F/V converter 46, then supplied to an addition point 49 in front of the driving amplifier 43 as a feedback signal together with a basic speed.

The speed calculator 48 receives the winding diameter Db from the measuring device 37, the motor speed Nb from the measuring device 47 and the gear ratio Gb from the gear ratio input device 63, and determines the let-off speed Vb from the calculation formula, i.e., $Vb=Nb \cdot Db \cdot Gb$, and supplies it to the pile scale factor calculator 51.

Meanwhile, the signal representing the ground warp tension correction amount k2 from the corrector 55 is added to the addition point 34, thereby correcting the target tension which is given from the target tension setting device 35.

Figure 4:
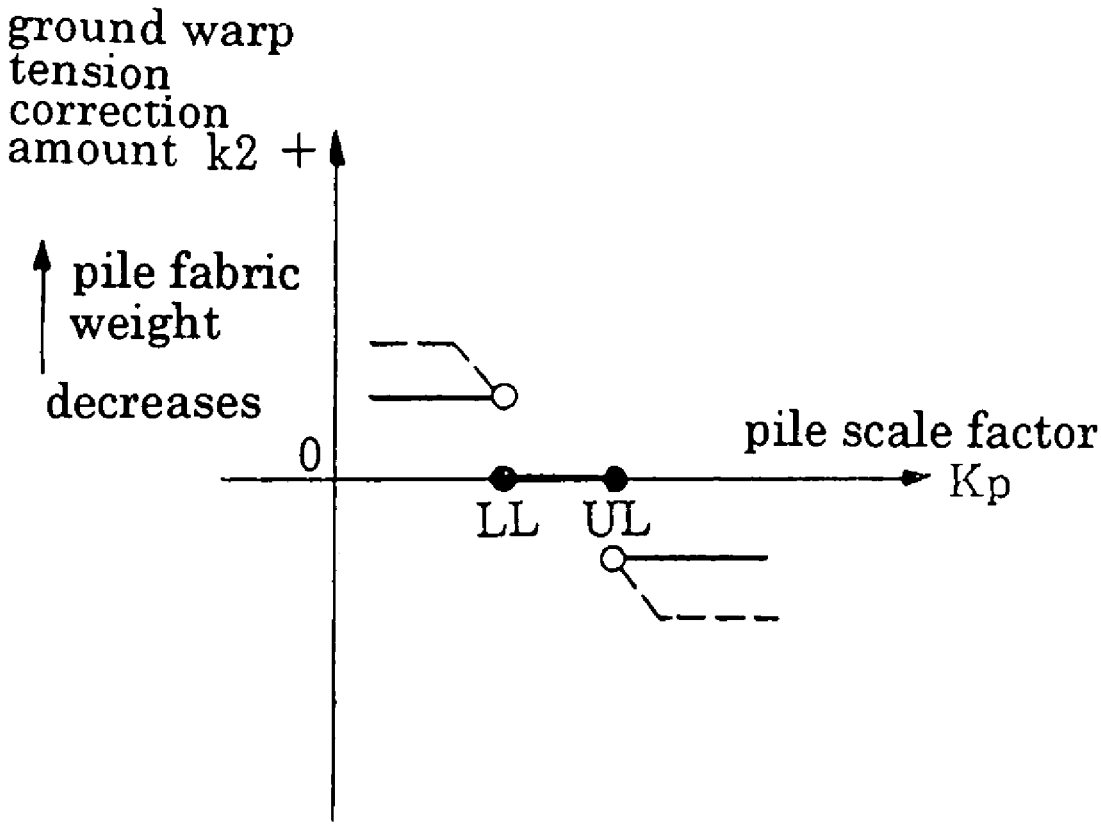
FIG. 4 is a graph showing the relationship between a pile scale factor and the amount of correction of a ground warp tension.

FIG. 4 shows the ground warp tension correction amount k2 within and beyond the tolerance of the pile scale factor Kp between the upper limit pile scale factor UL and the lower limit pile scale factor LL, while the lateral axis shows the pile scale factor Kp and the vertical axis shows the signal of the ground warp tension correction amount k2(tension–kg·f). If the pile scale factor Kp exceeds the upper limit pile scale factor UL, the ground warp tension correction amount k2 is given as a minus fixed value or a minus fixed value after it was changed at a prescribed inclination, while if it is less than the lower limit pile scale factor UL, it is given as a plus fixed value or a plus fixed value after it was changed at a prescribed inclination.

As already described in the item (2) relating to the ground warp tension, if the tension of the ground warp 18 increases during weaving of the pile fabric, the weft 23 is easily beaten up, and the returning amount of the cloth fell 7*a* owing to the overabundance of the cloth fell 7*a* decreases, so that the height of the pile increases, in other words, consumption of the pile warp 2 increases to increase the weight of the pile fabric.

Figure 5:
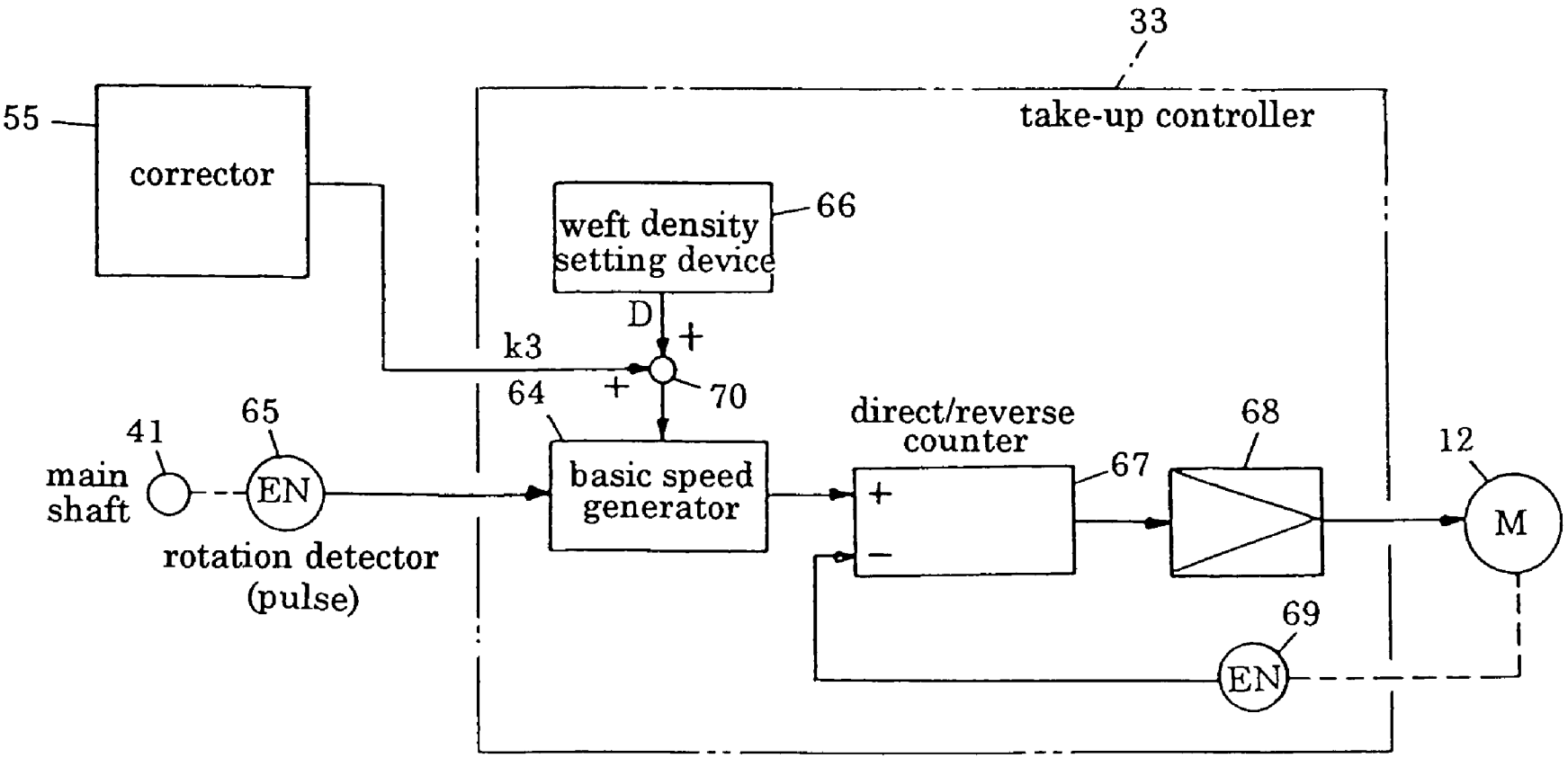
FIG. 5 is a block diagram of a take-up controller.

Next, FIG. 5 shows a concrete example of the take-up controller 33. In FIG. 5, a basic speed generator 64 in the take-up controller 33 fetches therein a rotation (speed) signal of the main shaft 41 from a rotation detector 65 and a signal representing weft density D from a weft density setting device 66, and generates a pulse signal of a basic speed for taking up, and supplies it to a plus input terminal of a direct/reverse counter 67. The direct/reverse counter 67 generates an output for taking up in response to the basic speed signal, and supplies it to a driving amplifier 68. Accordingly, the driving amplifier 68 drives the driving motor 12 for taking up and takes up the woven cloth 7 following the progress of the weaving.

The rotation of the driving motor 12 for taking up is detected by the rotation detector 69, and is supplied to a minus input terminal of the direct/reverse counter 67 as a signal representing the number of actual revolutions. Accordingly, at the time when the driving motor 12 turns by a prescribed number of revolutions, an output (speed command signal) of the direct/reverse counter 67 becomes zero, so that the driving amplifier 68 stops the driving of the driving motor 12. In such a manner, the take-up controller 33 turns or stops the driving motor 12 in response to the rotation of the main shaft 41, thereby maintaining the cloth fell 7*a* at a prescribed position.

Meanwhile, the signal representing weft density correction amount k3 from the corrector 55 is added to the addition point 70 between the basic speed generator 64 and the weft density setting device 66 to correct the signal of the weft density D which is given by the weft density setting device 66.

Figure 6:
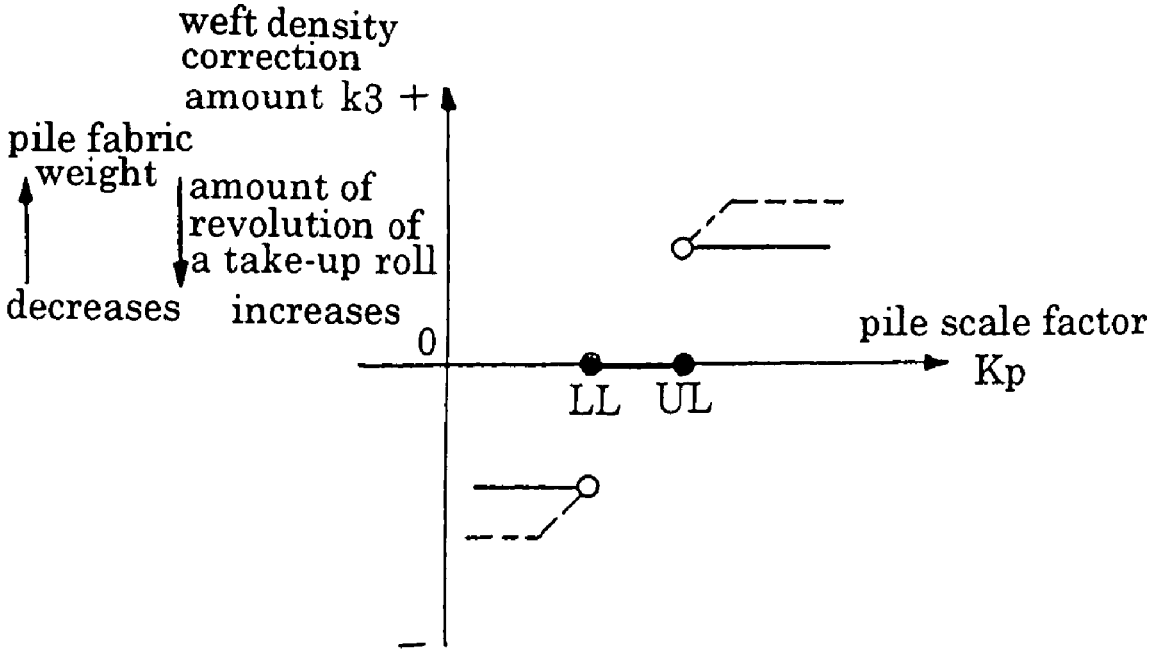
FIG. 6 is a graph showing the relationship between the pile scale factor and the amount of correction of a weft density.

FIG. 6 shows the weft density correction amount k3 within and beyond the tolerance of the pile scale factor Kp between the upper limit pile scale factor UL and the lower limit pile scale factor LL, while the lateral axis shows the pile scale factor Kp and the vertical axis shows the signal representing the weft density correction amount k3 (pick/inch). If the pile scale factor Kp exceeds the upper limit pile scale factor UL, the waft density correction amount k3 is given as a plus fixed value or a plus fixed value after it was changed at a prescribed inclination, while if it is less than the lower limit pile scale factor LL, it is given as a minus fixed value or a minus fixed value after it was changed at a prescribed inclination.

As already described in the item (3) relating to the warp density, if the number of bearing of the weft 23 decreases, in other words, if the warp density is coarse, the weft 23 is easily beaten up, the returning amount of the cloth fell 7*a* owing to the overabundance of the cloth fell 7*a* decreases, so that the height of the pile increases, in other words, consumption of the pile warp 2 increases to increase the weight of the pile fabric.

Figure 7:
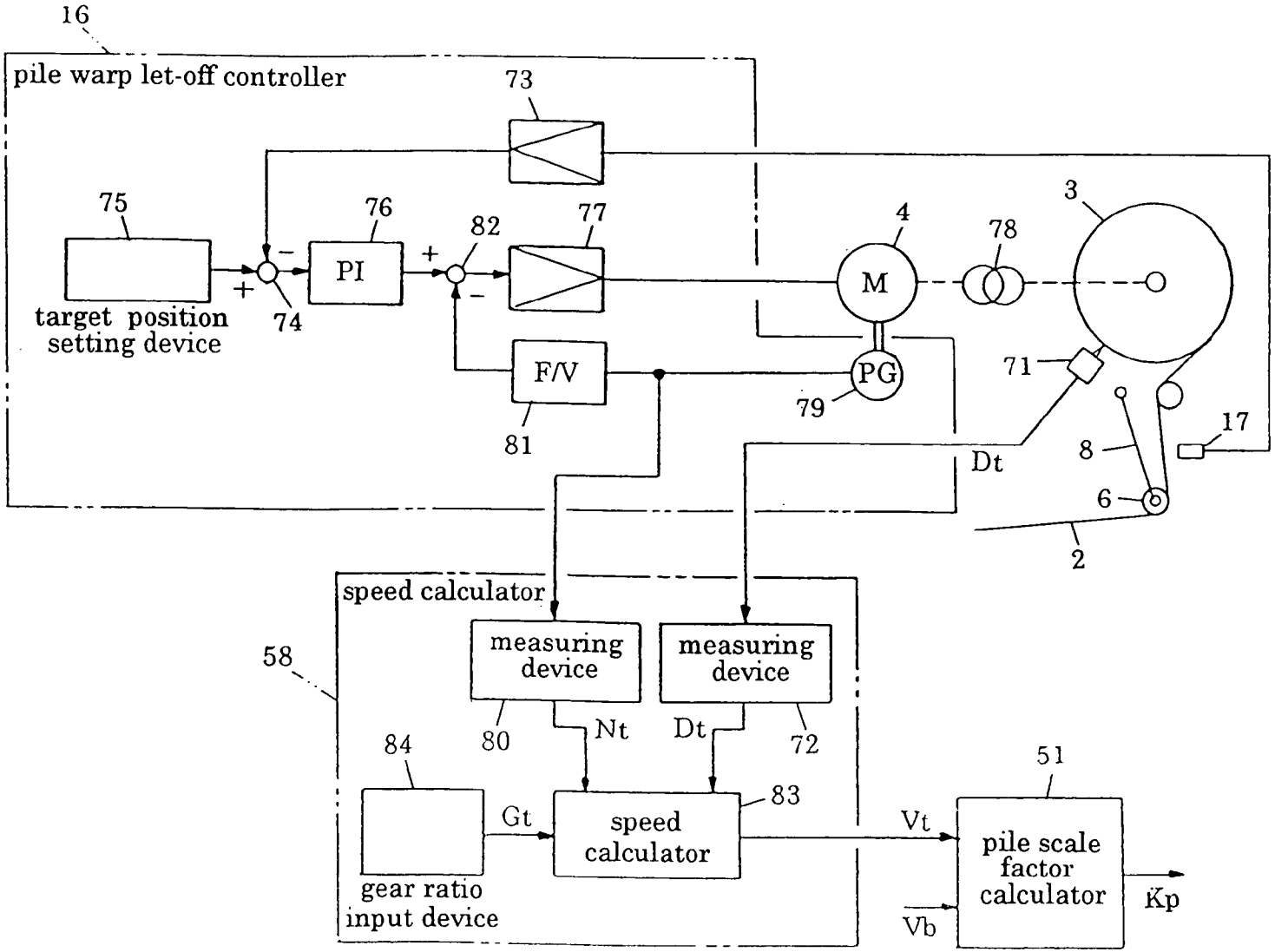
FIG. 7 is a block diagram of a pile warp let-off controller.

FIG. 7 shows a concrete example of the pile warp let-off controller 16. The pile warp 2 is unwound from the let-off beam 3 and contacts the tension roll 6 and it is let off in the direction of the cloth fell 7*a*. A winding diameter Dt of the let-off beam 3 is electrically detected by a winding detector 71 and is supplied to a measuring device 72. The position of the tension lever 8 is electrically detected by the displacement detector 17 such as a proximity sensor and is negatively fed back to an addition point 74 via an amplifier 73. The target position of the tension lever 8 is given to the addition point 74 by a target position setting device 75.

Accordingly, a PI controller 76 controls the number of revolutions of the let-off motor 4 through the driving amplifier 77 based on the proportion and integration operation in response to the deviation between the position of the tension lever 8 and the target position, and turns the let-off beam 3 of the pile warp 2 through the reduction gear 78 in the let-off direction. The number of revolutions of the let-off motor 4 is detected by a pulse generator 79, and given to a measuring device 80 for measuring a motor speed Nt and an F/V converter 81, then supplied to an addition point 82 in front of the driving amplifier 77 as a feedback signal.

The speed calculator 83 receives the winding diameter Dt from the measuring device 72, and the motor speed Nt from the measuring device 80 and a gear ratio Gt from the gear ratio input device 84, and determines the let-off speed Vt from the calculation formula, i.e., $Vt=Nt \cdot Dt \cdot Gt$, and supplies it to the pile scale factor calculator 51.

Figure 8:
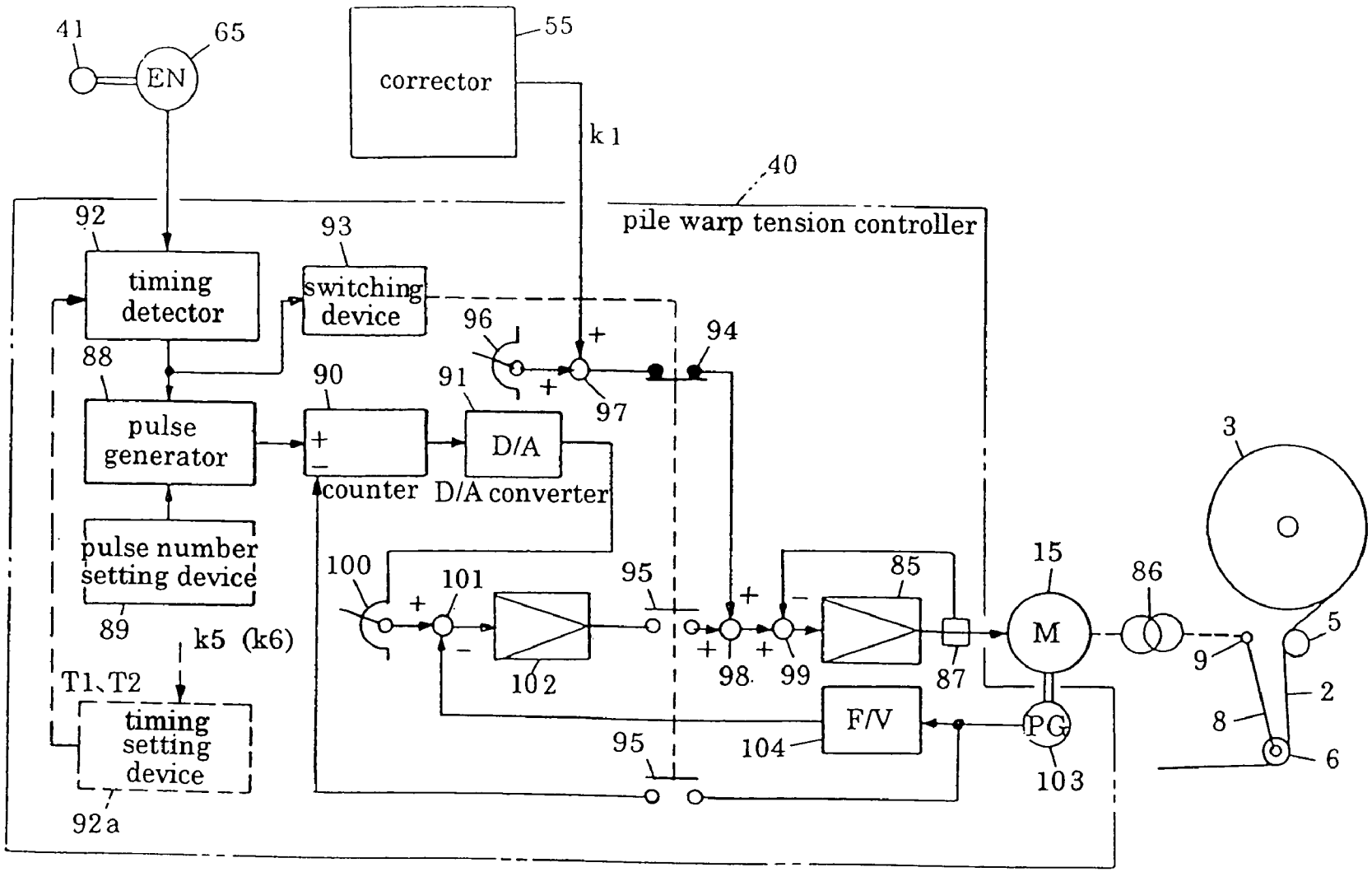
FIG. 8 is a block diagram of a pile warp tension controller.

FIG. 8 shows a concrete example of the pile warp tension controller 40. The rotation of the main shaft 41 is detected by the rotation detector 65 and is supplied to a timing detector 92. The timing detector 92 actuates a switching device 93 at a prescribed timing. The switching device 93 performs a switching operation at a prescribed turning angle of the main shaft 41 and selectively switches between a contact 94 and two contacts 95. Accordingly, the tension lever 8 is switched between a torque control system and a position control system.

When the contact 94 is ON, the torque control system operates, so that a target torque from a torque setting device 96 is added from addition points 98, 99 to a driving amplifier 85 through an addition point 97, and the contact 94. The driving amplifier 85 drives the electric actuator 15 for the torque control system with a prescribed current and supplies necessary torque to the tension lever 8 via gear 86. The torque of the tension lever 8 at this time conforms to the target tension of the pile warp 2. Such a torque control is mainly executed at the time of loose picking. A current value at the output side of the driving amplifier 85 is detected by a current detector 87 and it is negatively fed back to the addition point 99.

In the process of the torque control if the pile warp tension correction amount k1 is zero, the target tension value of the torque setting device 96 becomes a command value as it is. However, if the pile warp tension correction amount k1 is not zero, this is supplied to the addition point 97, so that the torque control target value becomes the sum of the tension value from the torque setting device 96 and the pile warp tension correction amount k1. In such a manner, the torque of the tension lever 8 acts in a direction to draw the pile warp 6 in the process of pile formation, which affects on the pile formation length (height) of the pile which was formed in the previous first picking.

In such a manner, the pile length (height) indirectly controls the amount of missing plush in a missing plush loop phenomenon when adjusting the tension of the pile warp 2 at the time of loose picking, thereby controlling the pile length during weaving. Accordingly, the maximum pile length is restricted by a reed escape amount which is set by the terry motion mechanism 24.

Figure 9:
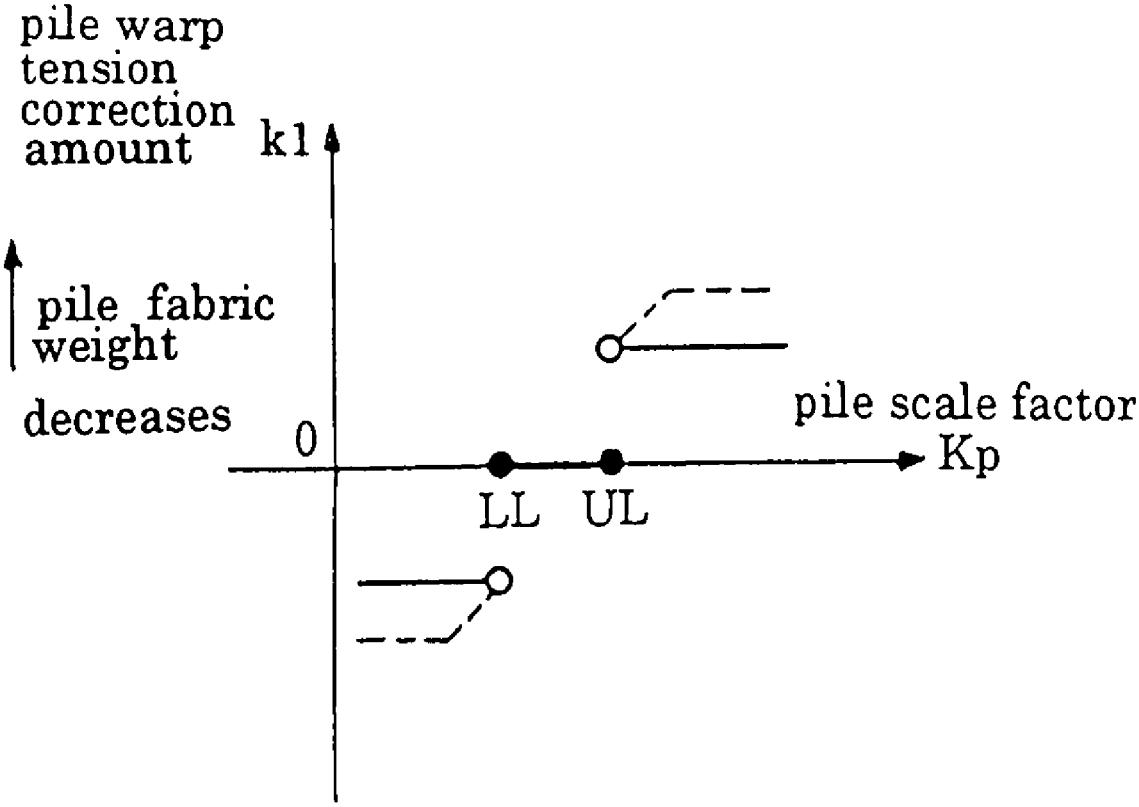
FIG. 9 is a graph showing the relationship between the pile scale factor and the amount of correction of the pile warp tension.

FIG. 9 shows the pile warp tension correction amount k1 within and beyond the tolerance of the pile scale factor Kp between the upper limit pile scale factor UL and the lower limit pile scale factor LL while the lateral axis shows the pile scale factor Kp and the vertical axis shows the signal representing the pile warp tension correction amount k1 (torque value–kg·cm). If the pile scale factor Kp exceeds the upper limit pile scale factor UL, the pile warp tension correction amount k1 is given as a plus fixed value or a plus fixed value after it was changed at a prescribed inclination, while if it is less than the lower limit pile scale factor LL, it is given as a minus fired value or a minus fixed value after it was changed at a prescribed inclination.

As already described in the item (1) relating to the pile warp tension, if the tension value of the pile warp 2 decreases, the tension of the pile warp at the time of beating when the pile is generated decreases, so that the height of the pile increases, in other words, consumption of the pile warp 2 increases, and the weight of the pile fabric increases.

Associated with the pile formation at the time of first picking, the tension lever 8 is controlled by the positional control system since the switching device 93 renders two contacts 95 ON during the sharp movement of the pile warp 2, in other words, according to the fabric movable type terry motion, during the retraction of the woven cloth 7 so as to form the pile or during the advancement of the woven cloth 7 so as to start a next loose picking after the pile formation.

According to the control by the positional control system, the pulse generator 88 receives a timing signal from the timing detector 92 and also receives a signal representing the number of pulses from the pulse number setting device 89, and outputs the number of pulses necessary for positional control to an up input terminal of the counter 90 every prescribed turning angle of the main shaft 41. A digital output from a counter 90 is supplied to the input terminal of a positional setting device 100 by a D/A converter 91 as an analog signal.

The analog output of the positional setting device 100 becomes an input of an amplifier 102 via an addition point 101 and it is supplied to the driving amplifier 85 through the addition points 98, 99 when the contact 95 is ON. At this time, the electric actuator 15 turns in a prescribed direction by a necessary amount, thereby turning the tension lever 8 to advance or retract the tension roll 6 at a prescribed position, so that the position of the tension roll 6 is controlled.

The number of revolutions of the electric actuator 15 is detected by a pulse generator 103 and it is returned to a down input terminal of the counter 90 via the contact 95. Accordingly, the counter 90 continues to output the digital output until the output of the counter 90 becomes zero, i.e., until the electric actuator 15 finishes the rotation by the given number of revolution. The pulse output of a pulse generator 103 is converted into a voltage by an F/V converter 104, and is negatively fed back to the addition point 101 as a feedback signal.

Unconcerned missing plush loop which occurred in connection with a sharp movement of the pile warp 2 can be prevented by the positional control of the tension roll 6. Since this positional control is a feedback control, the precise setting is enabled and also a continuous change of the pile length during weaving is possible.

Although according to the embodiment, the pile warp tension has to be corrected during the entire period when the pile weaving is performed when the pile scale factor Kp deviates from the tolerance, the pile warp tension alone may be corrected during a partial period of pile weaving, e.g., during a period where the relative movement between the reed 28 and woven cloth 7 is performed.

More in detail, with the pile tension controller 40 shown in FIG. 8, as shown in dotted lines, a timing setting device 92*a* is connected to the timing setting device 92. A signal representing the start timing correction amount kb is inputted from a corrector 55 as shown in FIG. 2 to the timing setting device 92*a*. A positional control start timing and a positional control end timing are set previously in the timing setting device 92*a*, wherein the timing setting device 92*a* performs the correction by adding a value of correction amount k7 to a value of the positional control start timing, and outputs it as a start timing T1 and also outputs a set value of the positional control end timing as an end timing T2, both of which are respectively supplied to the timing detector 92, where the timing detector 92 outputs a command to select the positional control to the switching device 93 if the turning angle of the main shaft 41 is within the range from the timing T1 to the timing T2.

Figure 12:
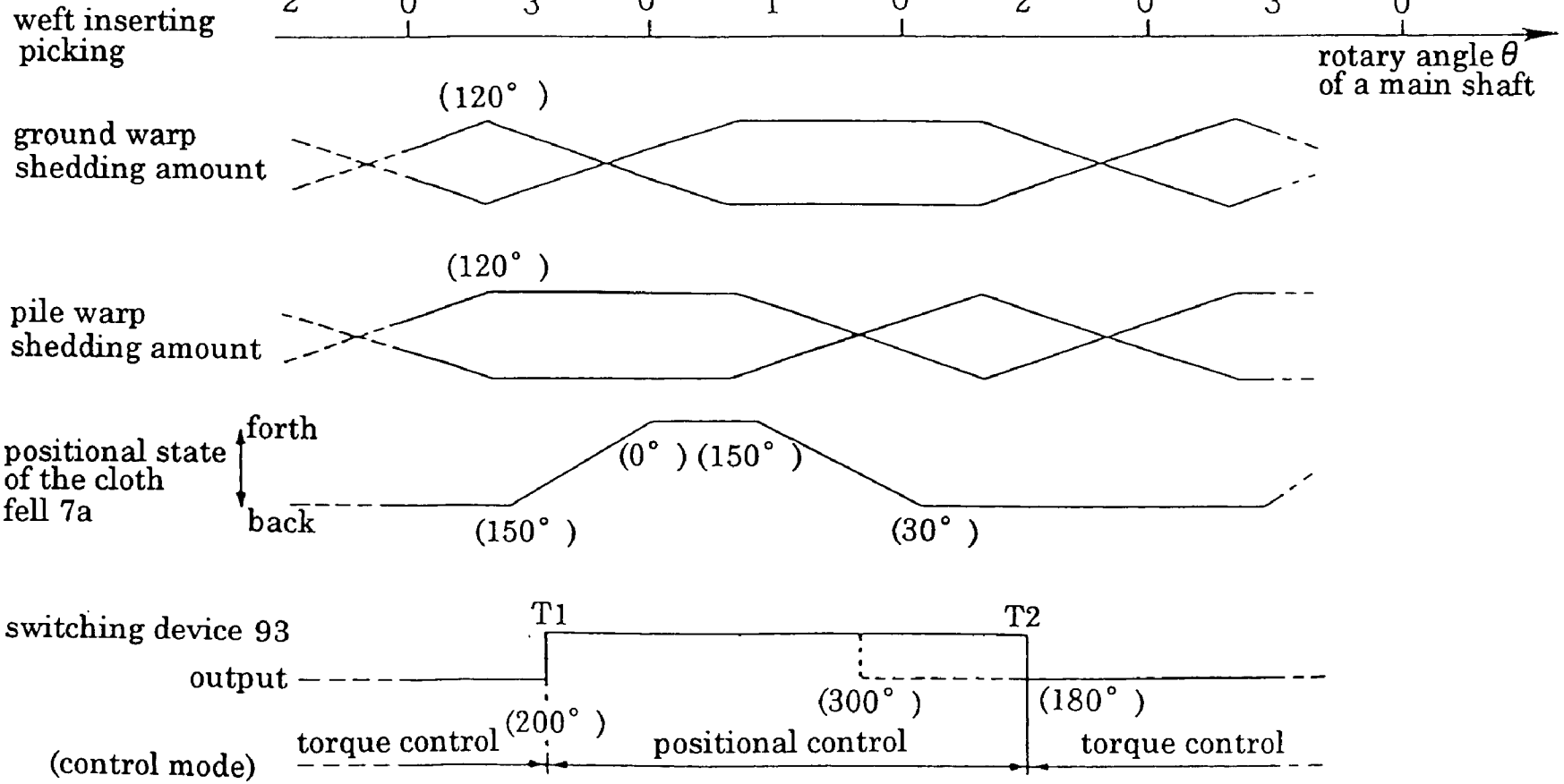
FIG. 12 is a timing chart showing the state of control of the pile warp tension controller.

FIG. 12 shows characteristics of the cloth movable type pile loom 1 including the shedding amount of the ground warp 18 and the pile warp 2, the positional state of the cloth fall 7*a*, and the output state of the switching device 93 during pile weaving period. The lateral axis shows the turning angle of the main shaft 41. 1 to 3 show a weft inserting picking, wherein 1 corresponds to a first pick, and 2 and 3 correspond to second and third picks serving as loose picking. The terry motion mechanism 24 is established such that the relative movement between the reed 28 and the woven cloth 7 is performed for pile formation; in more detail, the position of the cloth fell 7*a* advances during 150° of the third pick to 0° of the first pick, then the beating is performed at 0° of the first pick to generate the pile, then the position of the cloth fell 7*a* retracts during 150° to 0° of the first pick and 300 of the second pick. On the other hand, the positional control start timing which is set in the timing setting device 92*a* is set at 200° of the third pick, which is within a period from the start of advancement of the position of the cloth fell 7*a* to the end of advancement, and the positional control end timing is set at 180° of the second pick after the retraction of the cloth fell 7*a*.

If the value of the correction amount k7 is zero, since the selection signals from the timing detector 92 are inputted to the switching device 93 at the timing which is set in advance in the timing setting device 92*a*, the positional control and the torque control are selectively performed at the originally set timing. However, if the correction amount signal k5 is not zero, the period when the positional control is performed is changed relative to the relative movement between the reed 28 and the woven cloth 7, and hence the pile warp tension at the beating time for pile formation is changed, which influences the pile formation length.

Figure 13:
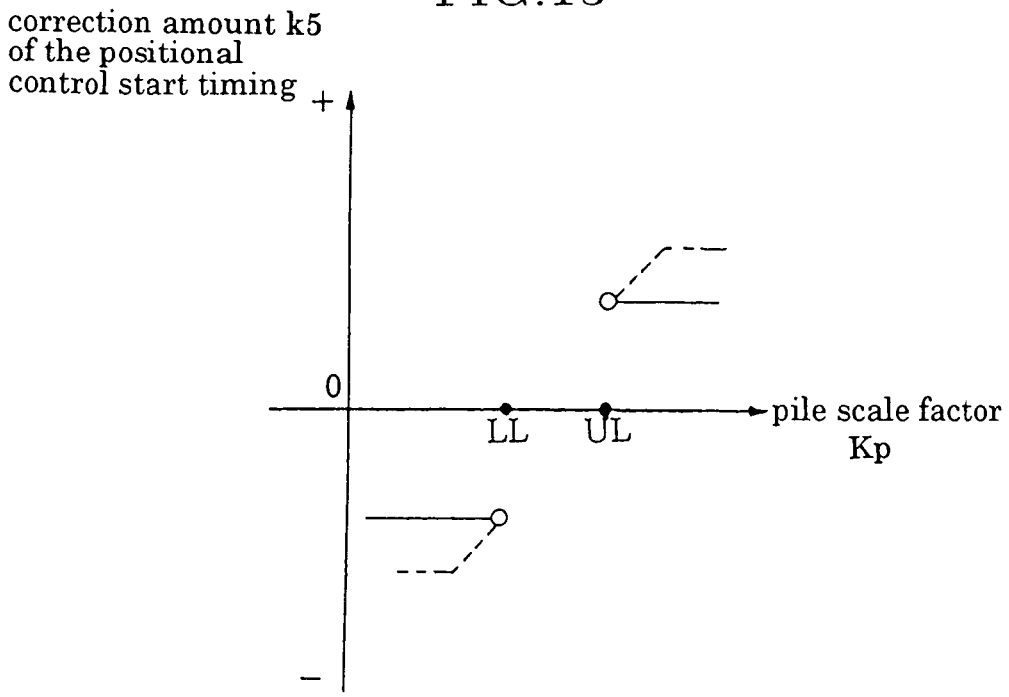
FIG. 13 is a graph showing the relationship between the pile scale factor and a positional control start timing.

FIG. 13 shows the correction amount k7 of the positional control start timing within and beyond the tolerance of the pile scale factor Kp between the upper limit pile scale factor UL and the lower limit pile scale factor LL, while the lateral axis shows the pile scale factor Kp and the vertical axis shows the signal representing the correction amount 5 of the positional control start timing (°). If the pile scale factor Kp exceeds the upper limit pile scale factor UL, the correction amount k7 of the positional control start timing is given as a plus fixed value or a plus fired value after it was changed at a prescribed inclination, while if it is less than the lower limit pile scale factor LL, it is given as a minus fixed value or a minus fixed value after it was changed at a prescribed inclination.

If the pile scale factor Kp increases to exceed the upper limit pile scale factor UL, the positional control start timing of the tension roll 6 is corrected in a direction to be delayed, so that the period where the positional control is performed is shortened relative to the period where the position of the cloth fell 7*a* advances, and hence the pile warp tension is higher than the prescribed low tension at the time of pile formation beating (0° of the first pick), thereby forming the pile having a height which is lower than that in normal pile formation. On the contrary, if the pile scale factor Kp decreases and is less than the lower limit pile scale factor LL, the positional control start timing of the tension roll 6 is corrected in a direction to be advanced, the period where the positional control is performed is lengthened relative to the period where the position of the cloth fell 7*a* advances so that the pile warp tension is lower than the prescribed low tension at the time of pile formation beating (0° of first pick), thereby forming pile having a height which is lower than that in the normal pile formation.

Figure 14:
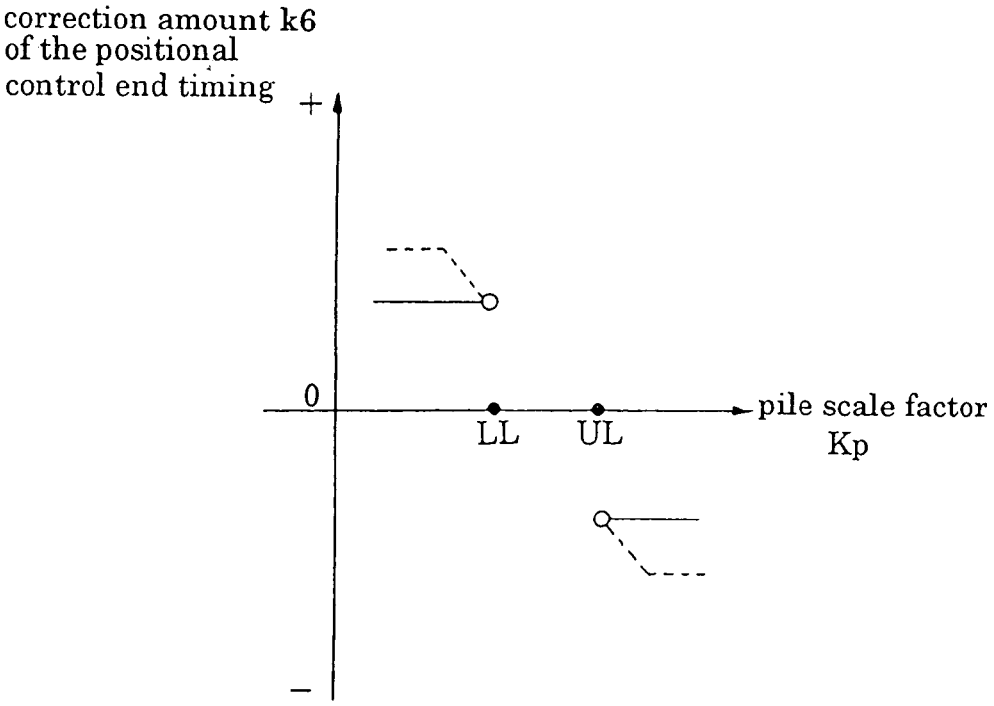
FIG. 14 is a graph showing the relationship between the pile scale factor and a positional control end timing.

Although the positional control start timing is corrected corresponding to the pile scale factor Kp, the positional control end timing may be corrected instead. In this case, the corrector 55 is structured to output a signal representing a correction amount k6 of the positional control end timing, and the positional control end timing which is set at the timing setting device 92*a* is, e.g., at 300° of the first pick (dotted lines in FIG. 12) which is in the period between the start of the retraction of the position of the cloth fell 7*a* to the end of the retraction thereof. On the other hand, if the pile scale factor Kp exceeds the upper limit pile scale factor UL as shown in FIG. 14, the correction amount k6 of the positional control end timing is set via the correction amount setting device 62 such that it is given as a minus fixed value or a minus fixed value after it was changed at a prescribed inclination, while if it is less than the lower limit pile scale factor LL, it is given as a plus fixed value or a plus fixed value after it was changed at a prescribed inclination.

If the pile scale factor Kp increases to exceed the upper limit pile scale factor UL, the positional control end timing of the tension roll 6 is corrected in a direction to be advanced, so that the period where the positional control is performed is shortened relative to the period where the position of the cloth fell 7*a* retracts, and hence the pile warp tension is higher than a desired state. Further, at the period immediately after the pile formation, the holding force of the pile warp 2 by the weft 23 is insufficient, so that the amount of heat pile warp 2 to be drawn from the pile tissue increases, thereby forming a pile having a height lower than that in a normal pile formation. On the contrary, if the pile scale factor Kp decreases and is less than the lower limit pile scale factor LL, the positional control end timing of the tension roll 6 is corrected in a direction to be advanced, so that the period where the positional control proceeds relative to the period where the position of the cloth fell 7*a* is retracted is lengthened. As a result, the warp tension after the pile formation becomes lower than the desired state and the amount of the pile warp 2 to be drawn from the pile tissue decreases, thereby forming pile having a height which is higher than that in the normal pile formation.

As mentioned above, either of the positional control start timing or the positional control end timing may be corrected corresponding to the pile scale factor Kp, or it may be structured so that both the positional control start timing and the positional control end timing may be corrected.

Further, the pile tension controller 40 is not limited to the structure where the control of the tension roll 6 for the pile warp 2 is switched between the positional control and the torque control matching with the relative movement between the reed 28 and the woven cloth 7 as shown in FIG. 8. For example, the pile tension controller 40 can have a plurality of urging forces of the tension roll 6 are set, wherein a low urging force is set at the period where the relative movement between the reed 28 and the woven cloth 7 is performed compared with the urging force at a period other than that period and the urging force corresponding to each period can be selected. Further, each urging force is corrected in response to the pile scale factor Kp, or an urging force during a period where the relative movement between the reed 28 and the woven cloth 7 is performed is corrected, or the timing for switching the urging forces is corrected, thereby adjusting the pile warp tension at the time of beating for generating the pile or at the period succeeding the foregoing period where the pile holding force is insufficient, so that the height of the pile and the weight of the pile fabric can be changed.

Figure 10:
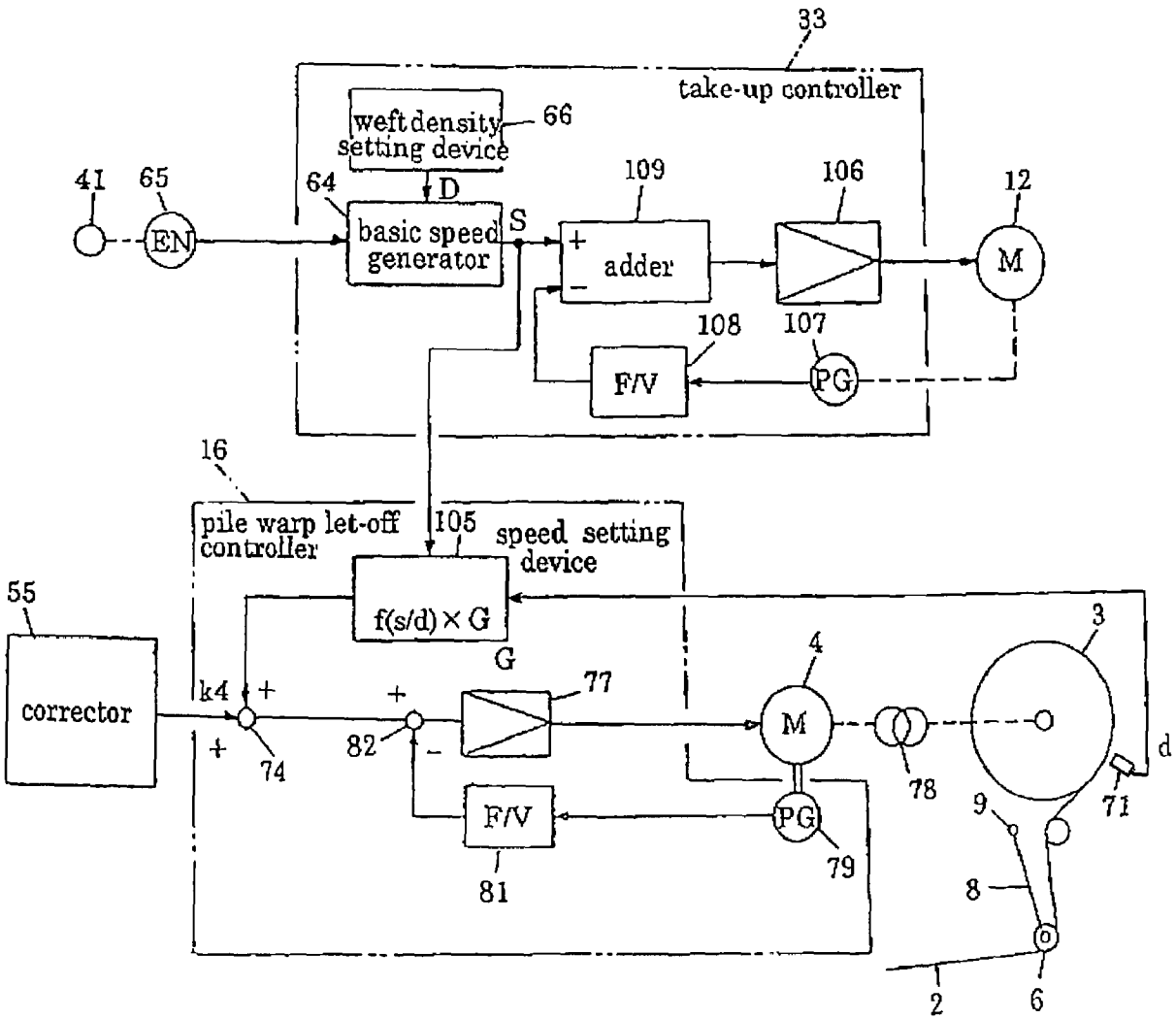
FIG. 10 is a block diagram of another pile warp let-off controller.

Further, the pile tension controller 40 is not limited to the foregoing embodiments. It can be structured, for example, such that the revolution speed of the let-off beam 3 of the pile warp 2, which is driven corresponding to the winding speed of the woven cloth 7, is controlled to adjust the pile warp tension. FIG. 10 shows a modification to utilize the output of the basic speed generator motor 64 of the take-up control device motor 33 as an input of the pile warp let-off control device 16.

The signal representing the weft density D from the weft density setting device 66 in FIG. 10 is supplied directly to the basic speed generator 64. The basic speed generator 64 fetches the revolution (speed) signal of the main shaft 41 from the rotation detector 65 and the signal of the weft density D, and supplies the signal of the basic speed s for winding to the plus input terminal of an adder 109 and also supplies it to the speed setting device 105 of the pile warp let-off controller 16.

The adder 109 generates an output for winding based on the signal of the basic speed s and supplies it to an driving amplifier 106 where the driving amplifier 106 drives the driving motor 12 for taking-up to take-up the woven cloth 7 following the progress of the weaving. During this period, the rotation of the driving motor 6 is detected by a pulse generator 107, and is supplied to the minus input terminal of the adder 109 by an F/V converter 108 as a voltage signal representing the actual number of revolution. In such a manner, the take-up control device motor 33 maintains the cloth fell 7*a* at a prescribed position while turning and stopping the driving motor 12 corresponding to the rotation of the main shaft 41.

Meanwhile, the speed setting device 105 fetches a signal of the basic speed s from the basic speed generator 64 and a signal of the winding diameter d of the let-off beam 3 which is electrically detected by the winding detector 71, and calculates a speed command value with function (s/d) causing a speed command using these as parameters, and multiplies the speed command value by the gear ratio G of the gear 78, which is set inside the speed setting device 105, thereby generating the let-off signal. The let-off speed signal and the signal representing the let-off beam rotation correction amount k4 of the pile warp 2 are added and supplied to the driving amplifier 77 via the addition points 74, 82. In such a manner, the let-off beam 3 of the pile warp is driven in response to the signal of the winding basic speed s.

Figure 11:
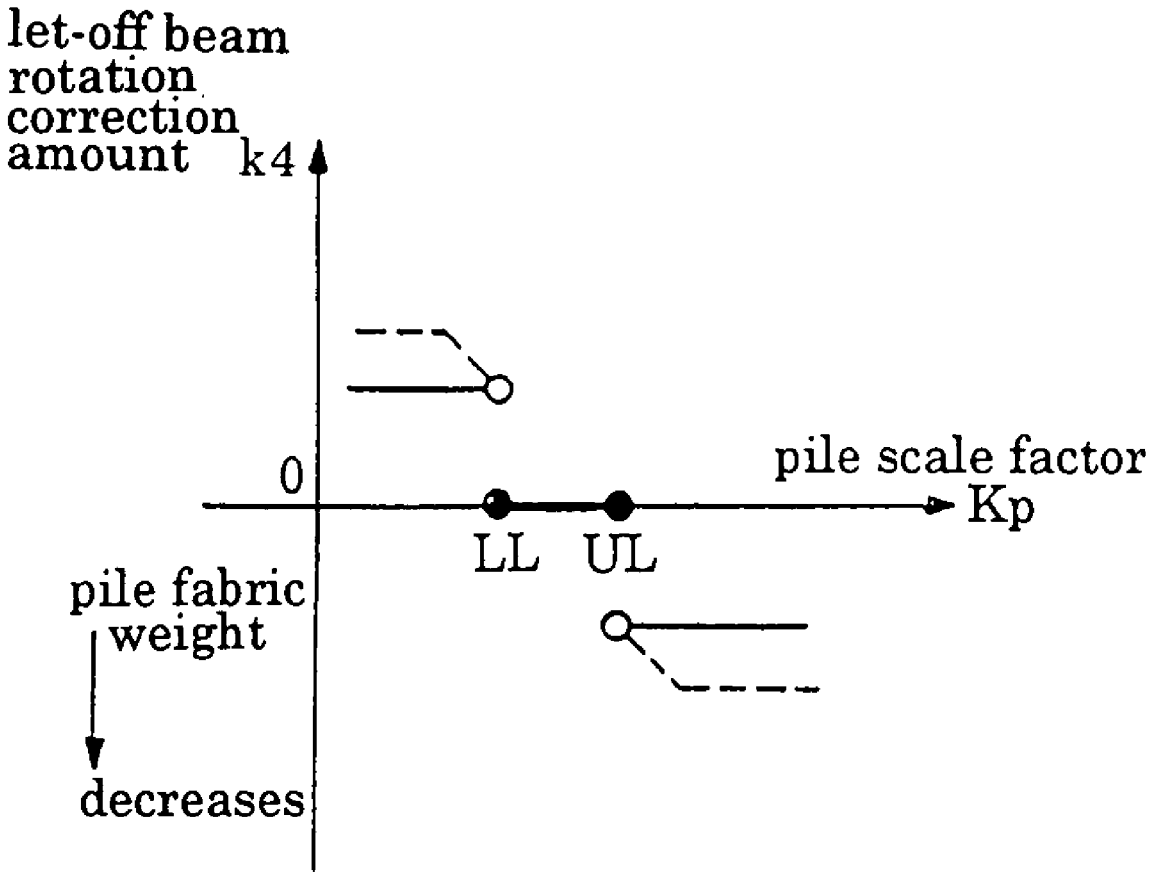
FIG. 11 is a graph showing the relationship between the pile scale factor and the amount of correction of the rotation of a pile warp let-off beam.

FIG. 11 shows the let-off beam rotation correction amount k4 within and beyond the tolerance of the pile scale factor Kp between the upper limit pile scale factor UT and the lower limit pile scale factor LL, while the lateral axis shows the pile scale factor Kp and the vertical axis shows the signal (speed v) representing the let-off beam rotation correction amount k4.

If the pile scale factor Kp exceeds the upper limit pile scale factor UL, the let-off beam rotation correction amount k4 is given as a minus fixed value or a minus fixed value after it was changed at a prescribed inclination, while if it is less than the lower limit pile scale factor LL, it is given as a plus fixed value or a plus fixed value after it was changed at a prescribed inclination. If the amount of revolution (feeding amount) of the pile warp beam 3 decreases, the pile warp tension increases, so that the height of the pile decreases to decrease the weight of the pile fabric.

If the pile scale factor Kp deviates from the tolerance, as the weaving condition parameter to be corrected, the parameter relating to the terry motion can be employed. For example, in a device which can adjust the amount of movement of the position of the cloth fell 7*a* via an electric actuator and so forth, i.e., in a so-called electronic pile device, the weaving condition parameter can be the amount of movement of the position of the cloth fell 7*a*, wherein if the amount of movement of the position of the cloth fell 7*a* between the first pick and the loose pick, namely, if the reed escape amount is made large, the pile having a higher height is formed to increase consumption of the pile warp, thereby increasing the weight of the pile fabric. This is not limited to the cloth movable type pile loom, and it is needless to say that it can be structured wherein the beating position is adjustable in the case of the reed movable type pile loom.

The amount of correction can be fixed to a fixed value, when the pile scale factor Kp deviates from the tolerance, irrespective of the amount of deviation relative to the upper limit pile scale factor UL or the lower limit pile scale factor LL, serving as the threshold, respectively, or it may be determined such that the amount of correction increases or decreases with a prescribed inclination in response to the amount of deviation. In the former case, since the correction relative to the weaving condition parameter gently continues until the pile scale factor returns to a value within the tolerance, the stability of the control is maintained, while in the latter case, the pile scale factor Kp can be quickly returned to a value within the tolerance by the large amount of correction relative to the weaving condition parameter. Meanwhile, if the pile scale factor Kp deviates largely from the tolerance, with the correction amount corresponding to the amount of control, excessive response occurs, so that the loom is subjected to an unstable control, resulting in deterioration of the operation of the loom. Accordingly, it is preferable that the amount of correction is set in the correction amount setting device 62 in the manner that the amount of correction increases or decreases in response to the amount of deviation until reaching the limit of the stable control of the pile scale factor Kp while it becomes the fixed multiple after reaching the limit of stable control of the pile scale factor Kp.

According to the first aspect of the invention, when the pile scale factor which is determined during pile weaving deviates from the tolerance, at least one weaving parameter associated with the weight of the pile is corrected in a direction to return the pile scale factor Kp to a value within the tolerance, so that the adjustment of the weaving condition parameter can be restrained to the minimum, thereby stabilizing the operation of the loom without deteriorating the quality of the pile fabric caused by the conventionally performed frequent adjustment.

According to the second aspect of the invention, when consumption of the pile warp, which is determined during pile weaving, deviates from the set tolerance, at least one weaving condition parameter associated with the weight of the pile is corrected in a direction to return consumption of the pile warp to a value within the tolerance, and it is sufficient to measure consumption of the pile warp in a direction to achieve the effect of the first aspect of the invention, resulting in the advantage of the capability of omitting the measurement of consumption of the ground warp.

According to the third aspect of the invention, since the tolerance is set considering the standard of the pile fabric, the weaving within the standard of the actual product is possible.

According to the fourth aspect of the invention, since the number of revolutions of the take-up roll as the weaving condition parameter is corrected to change the weft density of the pile fabric, the pile fabric can be controlled by a simple control of the number of revolutions at the take-up side.

According to the fifth aspect of the invention, since the number of revolutions of the ground let-off beam is controlled to change the target ground warp, tension of the ground warp can be controlled by a simple control of the number of revolutions at the let-off side.

According to the sixth aspect of the invention, when either the pile scale factor or consumption of the pile warp deviates from the tolerance, the target ground warp tension of the ground warp is changed and the amount of revolution of the take-up roll is corrected to change the warp density of the pile fabric so that the pile scale factor or consumption of the pile warp can be quickly set within the tolerance, which effectively acts on the heavyish pile fabric, and hence it is suitable for such heavyish pile fabric.

According to the seventh and eighth aspects of the invention, when either the pile scale factor or consumption of the pile warp deviates from the tolerance, the tension roll is urged via the electric actuator to correct the urging force relative to the pile warp, thereby directly coping with the pile warp.

According to the ninth aspect of the invention, the pile loom rotatably drives the pile warp beam at a speed corresponding to the rotation of the take-up roll and corrects the revolution speed of the pile warp beam when either the pile scale factor or consumption of the pile warp deviates from the tolerance, so that the pile scale factor or consumption of the pile warp can be controlled while harmonizing the rotation of the take-up roll and the pile warp beam.

According to the tenth and eleventh aspects of the invention, since the amount of correction of the weaving condition parameter is determined in response to the magnitude relation corresponding to the threshold of the tolerance, and the amount of correction of the weaving condition parameter is determined in response to the amount of deviation of the pile scale factor corresponding to the threshold of the tolerance, the amount of correction is not largely varied, thereby performing smooth control.

According to the twelfth aspect of the invention, since the warning signal is outputted when the calculated pile scale factor Kp deviates from the warning ranges, the warning state can be immediately confirmed by an operator, so that the operator can quickly cope with it.

The invention claimed is:

1. A method of controlling a pile loom that is provided with a device for calculating a pile scale factor based on a ratio between consumption of a ground warp and consumption of a pile warp during pile weaving, said method comprising:

setting a tolerance relative to the pile scale factor;

correcting at least one weaving condition parameter associated with a weight of pile so as to change the pile scale factor in a direction toward returning the pile scale factor to a value within the tolerance when a calculated pile scale factor deviates from the tolerance; and not correcting the weaving condition parameter when the calculated pile scale factor is within the tolerance.

2. A method of controlling a pile loom that is provided with a device for calculating a pile scale factor based on a ratio between consumption of a ground warp and consumption of a pile warp during pile weaving, said method comprising:

setting a tolerance relative to the pile scale factor;

correcting at least one weaving condition parameter associated with a weight of pile so as to change the consumption of the pile warp in a direction toward returning the consumption of the pile warp to a value within the tolerance when a calculated consumption of the pile warp deviates from the tolerance; and not correcting the weaving condition parameter when the calculated consumption of the pile warp is within the tolerance.

3. The method of controlling a pile loom according to claim 1, wherein said setting sets the tolerance in consideration of a standard of the pile fabric being made by the pile loom.

4. The method of controlling a pile loom according to claim 1, wherein the at least one weaving condition parameter includes a weft density of a pile fabric, and when the calculated pile scale factor deviates from the tolerance, the revolution of a take-up roll is corrected to change the weft density.

5. The method of controlling a pile loom according to claim 2 wherein the at least one weaving condition parameter includes a weft density of a pile fabric, and when the calculated consumption of the pile warp deviates from the tolerance, the revolution of a take-up roll is corrected to change the weft density.

6. The method of controlling a pile loom according to claim 1, wherein the pile loom includes a ground warp let-off control device for controlling the revolution of a ground warp let-off beam so as to tend to cancel deviation between a target ground warp tension and actual tension of the ground warp and the at least one weaving condition parameter includes the target ground warp tension of the ground warp to be set, and wherein if the calculated pile scale factor deviates from the tolerance, the ground warp tension of the ground warp is changed.

7. The method of controlling a pile loom according to claim 2, wherein the pile loom includes a ground warp let-off control device for controlling the revolution of a ground warp let-off beam so as to tend to cancel deviation between a target ground warp tension and actual tension of the ground warp and the at least one weaving condition parameter includes the target ground warp tension of the ground warp to be set, and wherein if the calculated consumption of the pile warp deviates from the tolerance, the ground warp tension of the ground warp is changed.

8. The method of controlling a pile loom according to claim 1, wherein the pile loom includes a ground warp let-off control device for controlling the revolution of a ground warp let-off beam so as to tend to cancel deviation between a target ground warp tension and actual tension of the ground warp and the at least one weaving condition parameter includes the target ground warp tension of the ground warp to be set and a weft density, wherein if the calculated pile scale factor deviates from the tolerance, the target tension of the ground warp is changed and the revolution of a take-up roll is corrected so as to change the weft density of the pile fabric being produced.

9. The method of controlling a pile loom according to claim 2, wherein the pile loom includes a ground warp let-off control device for controlling the revolution of a ground warp let-off beam so as to tend to cancel deviation between a target ground warp tension and actual tension of the ground warp and the at least one weaving condition parameter includes the target ground warp tension of the ground warp to be set and a weft density, wherein if the consumption of the pile warp deviates from the tolerance, the target tension of the ground warp is changed and the revolution of a take-up roll is corrected so as to change the weft density of the pile fabric being produced.

10. The method of controlling a pile loom according to claim 1, wherein the pile loom includes a tension roll swingably provided thereon and around which the pile warp extends and a pile tension controller for urging the tension roll via an electric actuator for generating torque corresponding to a previously set urging force and the at least one weaving condition parameter includes the urging force to be set for urging the tension roll, and wherein if the calculated pile scale factor deviates from the tolerance, the urging force of the tension roll is corrected.

11. The method of controlling a pile loom according to claim 2, wherein the pile loom includes a tension roll swingably provided thereon and around which the pile warp extends and a pile tension controller for urging the tension roll via an electric actuator for generating torque corresponding to a previously set urging force and the at least one weaving condition parameter includes the urging force to be set for urging the tension roll, and wherein if the consumption of the pile warp deviates from the tolerance, the urging force of the tension roll is corrected.

12. The method of controlling a pile loom according to claim 1, wherein the pile loom includes a tension roll swingably provided thereon and around which the pile warp extends and a pile tension controller for executing positional control over a timing period which is set within a first period when relative movement between a reed and the pile fabric for pile weaving and executing torque driving corresponding to the tension set during a period other than the first period, and the at least one weaving condition parameter includes at least one of positional control start timing and positional control end timing, respectively set, for executing positional control, and wherein if the calculated pile scale factor deviates from the tolerance, either the positional control start timing or the positional control end timing is corrected.

13. The method of controlling a pile loom according to claim 2, wherein the pile loom includes a tension roll swingably provided thereon and around which the pile warp extends and a pile tension controller for executing positional control over a timing period which is set within a first period when relative movement between a reed and the pile fabric for pile weaving and executing torque driving corresponding to the tension set during a period other than the first period, and the at least one weaving condition parameter includes at least one of positional control start timing and positional control end timing, respectively set, for executing positional control, and wherein if the consumption of the pile warp deviates from the tolerance, either the positional control start timing or the positional control end timing is corrected.

14. The method of controlling a pile loom according to claim 1, wherein the pile loom includes a let-off beam of the pile warp which is rotatably driven at a speed corresponding to the rotation of a take-up roll, wherein the at least one weaving condition parameter includes the speed of the let-off beam of the pile warp, and wherein if the calculated pile scale factor deviates from the tolerance, the speed of the let-off beam of the pile warp is corrected.

15. The method of controlling a pile loom according to claim 2, wherein the pile loom includes a let-off beam of the pile warp which is rotatably driven at a speed corresponding to the rotation of a take-up roll, wherein the at least one weaving condition parameter includes the speed of the let-off beam of the pile warp, and wherein if the calculated pile scale factor deviates from the tolerance, the speed of the let-off beam of the pile warp is corrected.

16. The method of controlling a pile loom according to claim 1, wherein the amount of correction of the at least one weaving condition parameter is determined in response to a magnitude relation corresponding to a threshold of the tolerance.

17. The method of controlling a pile loom according to claim 2, wherein the amount of correction of the at least one weaving condition parameter is determined in response to a magnitude relation corresponding to a threshold of the tolerance.

18. The method of controlling a pile loom according to claim 1, wherein the amount of correction of the at least one weaving condition parameter is determined in response to the amount of deviation of the pile scale factor corresponding to the threshold of the tolerance.

19. The method of controlling a pile loom according to claim 2, wherein the amount of correction of the at least one weaving condition parameter is determined in response to the amount of deviation of the pile scale factor corresponding to the threshold of the tolerance.

20. The method of controlling a pile loom according to claim 10, wherein warning ranges are set beyond the tolerance and a warning signal is outputted when the calculated pile scale factor deviates from the warning ranges.

21. The method of controlling a pile loom according to claim 12, wherein warning ranges are set beyond the tolerance and a warning signal is outputted when the calculated pile scale factor deviates from the warning ranges.

22. The method of controlling a pile loom according to claim 14, wherein warning ranges are set beyond the tolerance and a warning signal is outputted when the calculated pile scale factor deviates from the warning ranges.

* * * * *